US008074614B2

(12) United States Patent
Marriott et al.

(10) Patent No.: US 8,074,614 B2
(45) Date of Patent: Dec. 13, 2011

(54) INTEGRATED HYDRAULIC COOLER AND RETURN RAIL IN CAMLESS CYLINDER HEAD

(75) Inventors: Craig D. Marriott, Clawson, MI (US); Timothy L. Neal, Ortonville, MI (US); Jeff L. Swain, Flushing, MI (US); Miguel A. Raimao, Colorado Springs, CO (US)

(73) Assignee: GM Global Technology Operations LLC, Detroit, MI (US)

( * ) Notice: Subject to any disclaimer, the term of this patent is extended or adjusted under 35 U.S.C. 154(b) by 587 days.

(21) Appl. No.: 12/209,580

(22) Filed: Sep. 12, 2008

(65) Prior Publication Data

US 2010/0064990 A1 Mar. 18, 2010

(51) Int. Cl.
*F01L 9/02* (2006.01)

(52) U.S. Cl. ..... 123/90.12; 123/90.16

(58) Field of Classification Search ..... 123/90.12, 123/90.15, 90.16, 90.17
See application file for complete search history.

(56) References Cited

U.S. PATENT DOCUMENTS

| | | | | |
|---|---|---|---|---|
| 6,886,510 | B2 * | 5/2005 | Sun et al. | 123/90.12 |
| 7,194,990 | B2 | 3/2007 | Sun | |
| 2007/0137607 | A1 | 6/2007 | Ledbetter | |

FOREIGN PATENT DOCUMENTS

| | | | |
|---|---|---|---|
| CN | 101012783 | A | 8/2007 |
| CN | 101171405 | A | 4/2008 |
| JP | 57062911 | A * | 4/1982 |

OTHER PUBLICATIONS

Abstract of JP57062911 shown above.*

* cited by examiner

*Primary Examiner* — Zelalem Eshete
(74) *Attorney, Agent, or Firm* — Harness, Dickey & Pierce, P.L.C.

(57) ABSTRACT

An engine assembly may include a cylinder head defining an engine coolant reservoir, a pressurized fluid supply, a valve actuation assembly, and a hydraulic fluid reservoir. The valve actuation assembly may be in fluid communication with the pressurized fluid supply and may include a valve member displaceable by a force applied by the pressurized fluid supply. The hydraulic fluid reservoir may be in fluid communication with the valve actuation assembly and in a heat exchange relation to the engine coolant reservoir.

20 Claims, 4 Drawing Sheets

INTEGRATED HYDRAULIC COOLER AND RETURN RAIL IN CAMLESS CYLINDER HEAD

GOVERNMENT LICENSE RIGHTS

The U.S. Government has a paid-up license in this invention and the right in limited circumstances to require the patent owner to license others on reasonable terms as provided for by the terms of Government Program Number DE-FC26-05NT42415 for the High Energy Clean Combustion Project awarded by the U.S. Department of Energy.

FIELD

The present disclosure relates to hydraulic fluid cooling in engine assemblies, and more specifically to hydraulic fluid cooling in a camless engine valvetrain system.

BACKGROUND

The statements in this section merely provide background information related to the present disclosure and may not constitute prior art.

Engine assemblies using a camless hydraulically actuated valvetrain system may actuate intake and exhaust valves using a pressurized hydraulic fluid. The hydraulic fluid may be heated during engine operation. In order to maintain the hydraulic fluid at a desired temperature, additional lines and coolers may be added to an engine assembly.

SUMMARY

An engine assembly may include a cylinder head defining an engine coolant reservoir, a pressurized fluid supply, a valve actuation assembly, and a hydraulic fluid reservoir. The valve actuation assembly may be in fluid communication with the pressurized fluid supply and may include a valve member displaceable by a force applied by the pressurized fluid supply. The hydraulic fluid reservoir may be in fluid communication with the valve actuation assembly and in a heat exchange relation to the engine coolant reservoir.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
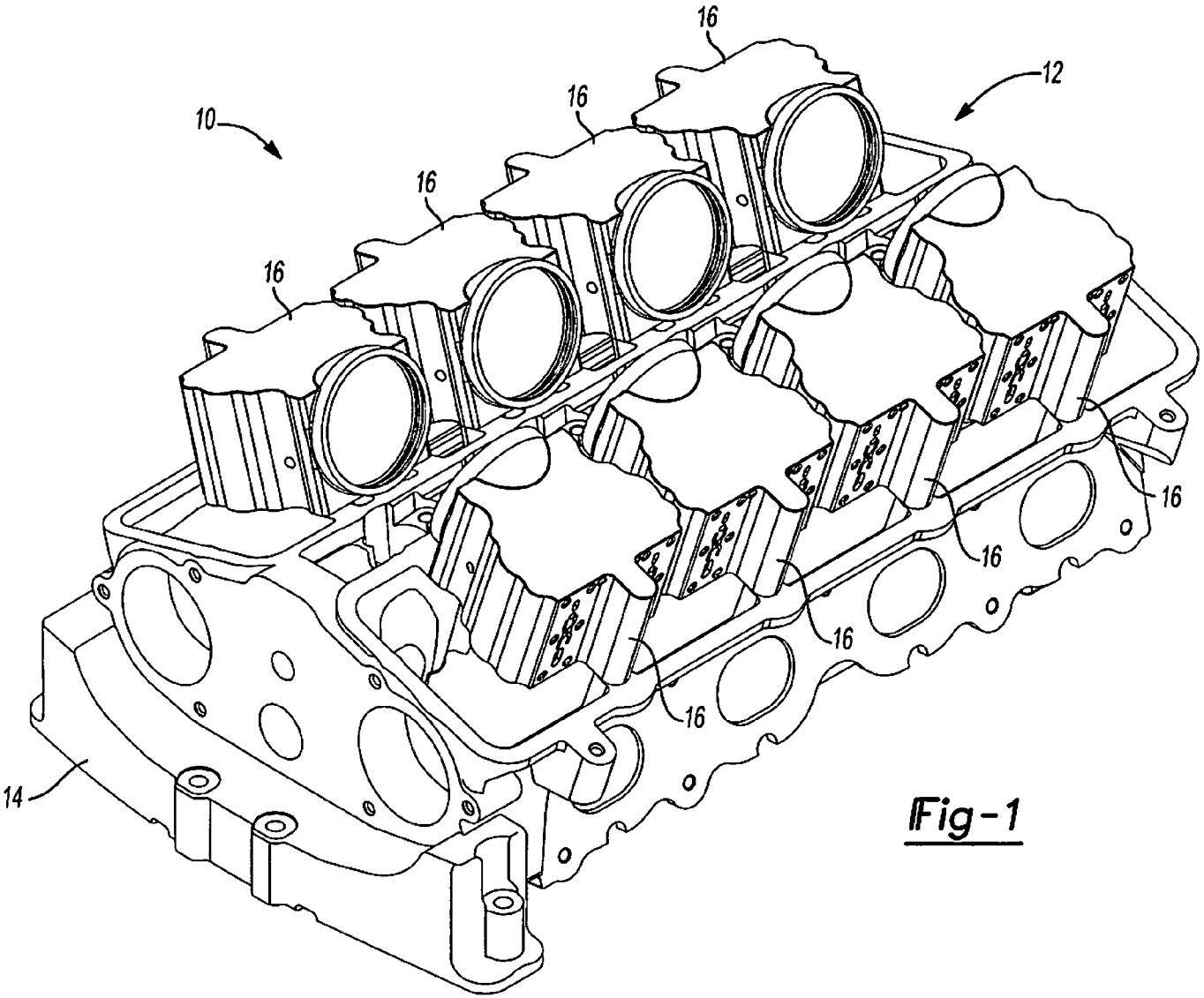
FIG. 1 is a perspective view of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Figure 4:
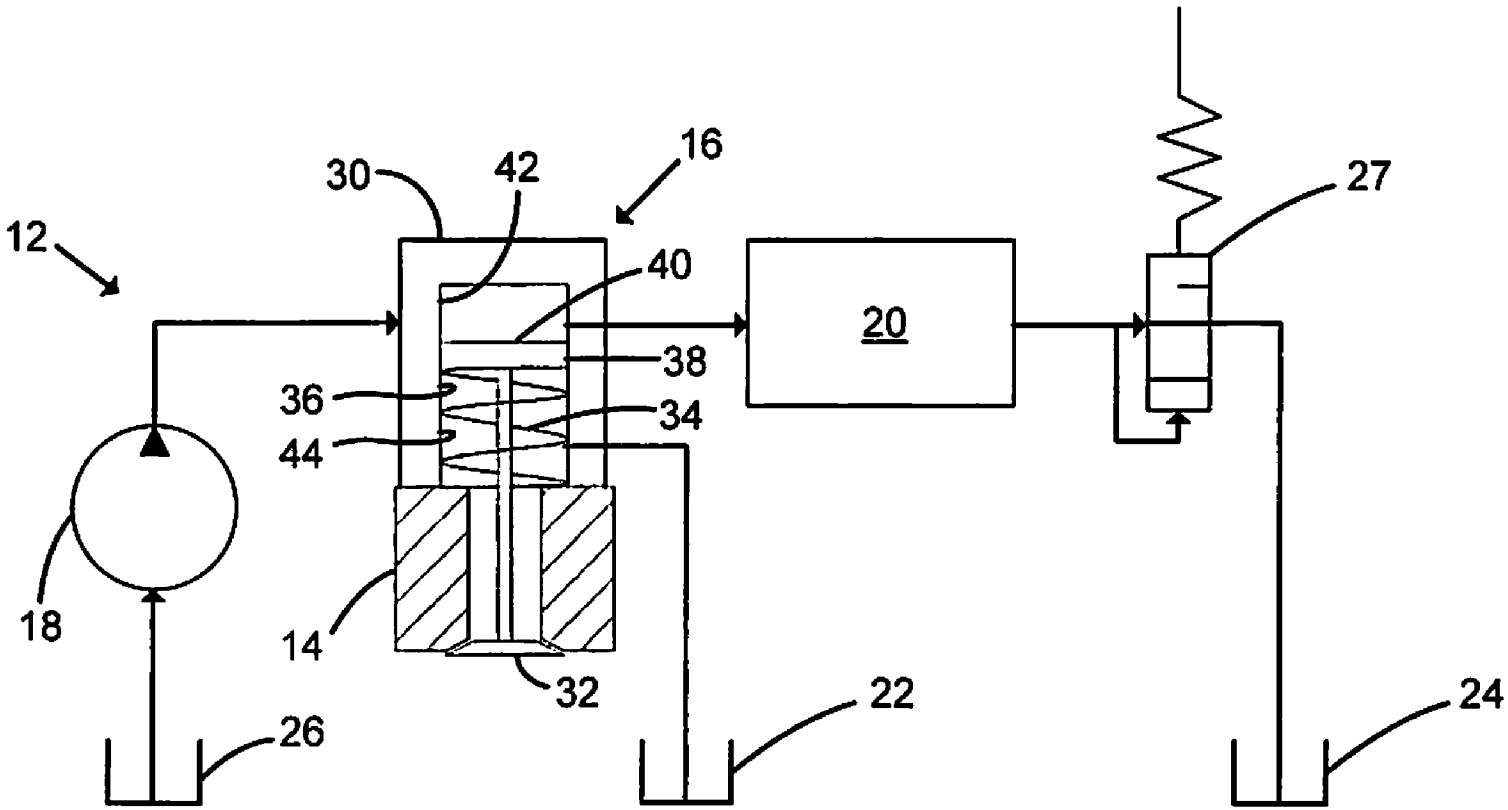
FIG. 4 is a schematic illustration of a camless valvetrain system of the engine assembly of FIG. 1.

Referring to FIGS. 1-4, an engine assembly 10 may include a camless valvetrain system 12 and a cylinder head 14. As illustrated in FIGS. 1 and 4, the camless valvetrain system 12 may include a valve actuation assembly including a series of valve actuation systems 16 supported on the cylinder head 14, a pump 18, first, second, third, and fourth hydraulic reservoirs 20, 22, 24, 26, and a backpressure regulator 27. The pump 18 may provide a pressurized fluid supply to the valve actuation systems 16.

In a simplified form for purposes of illustration, each of the valve actuation systems 16 may include a housing 30, a valve member 32, and a biasing member 34. While a single valve member 32 is shown, it is understood that each of the valve actuation systems 16 may include an intake and an exhaust valve. The housing 30 may define a chamber 36 housing an end 38 of the valve member 32. The end 38 of the valve member 32 may include a piston 40 separating the chamber 36 into first and second portions 42, 44. The valve actuation system 16 may be controlled to selectively provide communication between the first portion 42 of the chamber 36 and the first pump 18 in a first state and between the first portion 42 of the chamber 36 and the first hydraulic reservoir 20 in a second state.

During operation in the first state, the pressurized fluid supplied by the first pump 18 may force the valve member 32 into an open position against the force of the biasing member 34. During operation in the second state, the first portion 42 of the chamber 36 may be vented to the first hydraulic reservoir 20 and the biasing member 34 may force the valve member 32 into a closed position. The piston 40 may force the hydraulic fluid from the first portion 42 of the chamber 36 to the first hydraulic reservoir 20 when the first portion 42 of the chamber 36 is vented to the first hydraulic reservoir 20. Leakage of hydraulic fluid from the first portion 42 to the second portion 44 of the chamber 36 may pass to the second hydraulic reservoir 22.

The pump 18 may pump the hydraulic fluid from the fourth hydraulic reservoir 26 to the valve actuation systems 16. The second, third, and fourth hydraulic reservoirs 22, 24, 26 may be in communication with one another or may form a single hydraulic reservoir. Therefore, the pump 18 may be in communication with the first hydraulic reservoir 20. The backpressure regulator 27 may maintain the first hydraulic reservoir 20 at a predetermined pressure. By way of non-limiting example, the first hydraulic reservoir 20 may be maintained at a pressure greater than atmospheric pressure, and more specifically at approximately 500 kilopascal (kPa). When the pressure within the first hydraulic reservoir 20 exceeds the predetermined pressure, the first hydraulic reservoir 20 may be vented to the third hydraulic reservoir 24. The third hydraulic reservoir 24 may operate at a pressure less than the first hydraulic reservoir 20. By way of non-limiting example, the third hydraulic reservoir 24 may operate at approximately atmospheric pressure.

The first hydraulic reservoir 20 may be located within the cylinder head 14. The first hydraulic reservoir 20 may form a common reservoir for each of the valve actuation systems 16. For example, each of the valve actuation systems 16 associated with a cylinder bank may be in communication with the first hydraulic reservoir 20. More specifically, the cylinder head 14 may include cast passages forming the first hydraulic reservoir 20 and an engine coolant reservoir 46. The engine coolant reservoir 46 may form a cooling jacket used for cooling the cylinders (not shown) of the engine assembly 10.

Figure 2:
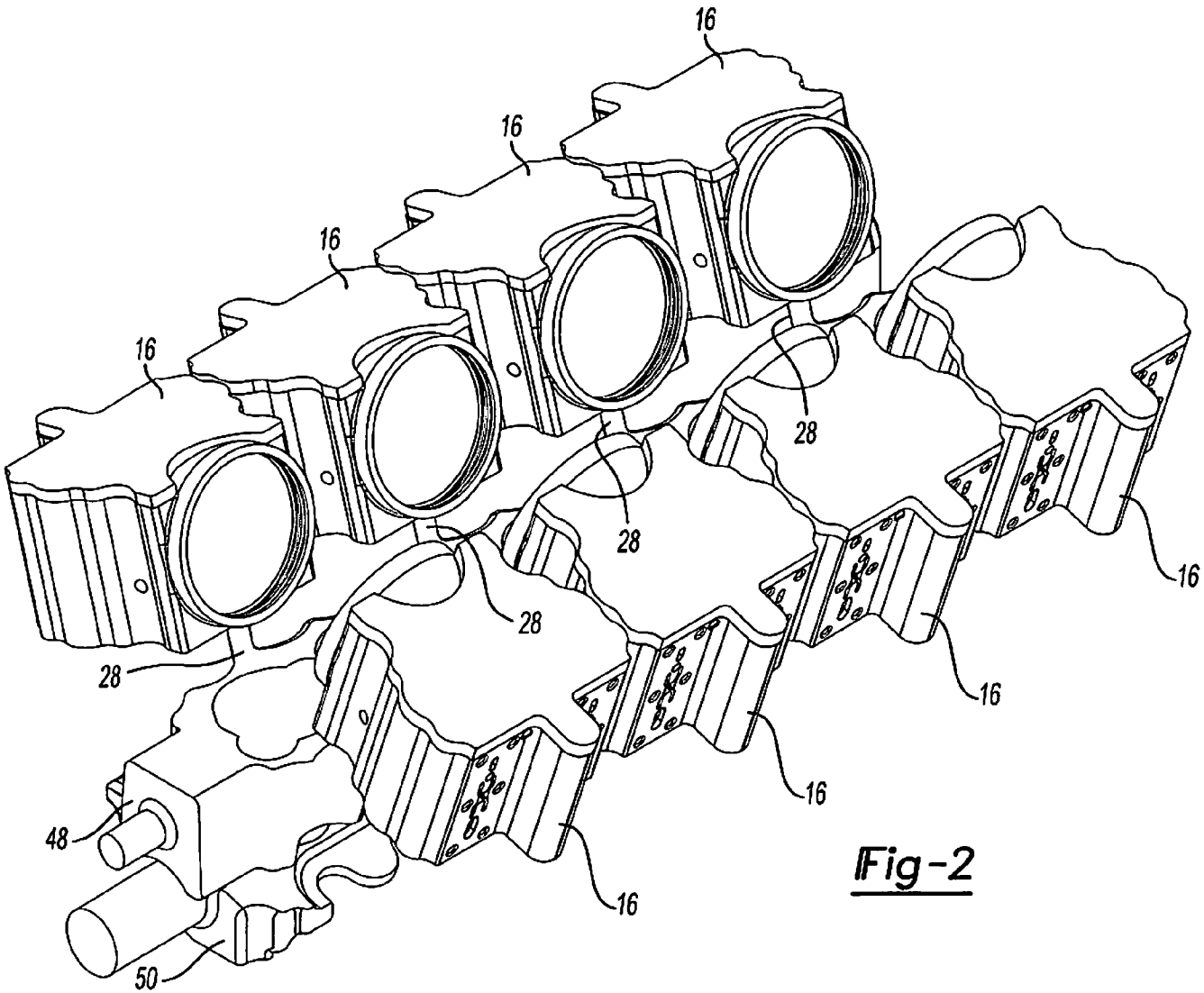
FIG. 2 is a perspective view of a portion of the engine assembly of FIG. 1 and a flow path within the engine assembly of FIG. 1.
Figure 3:
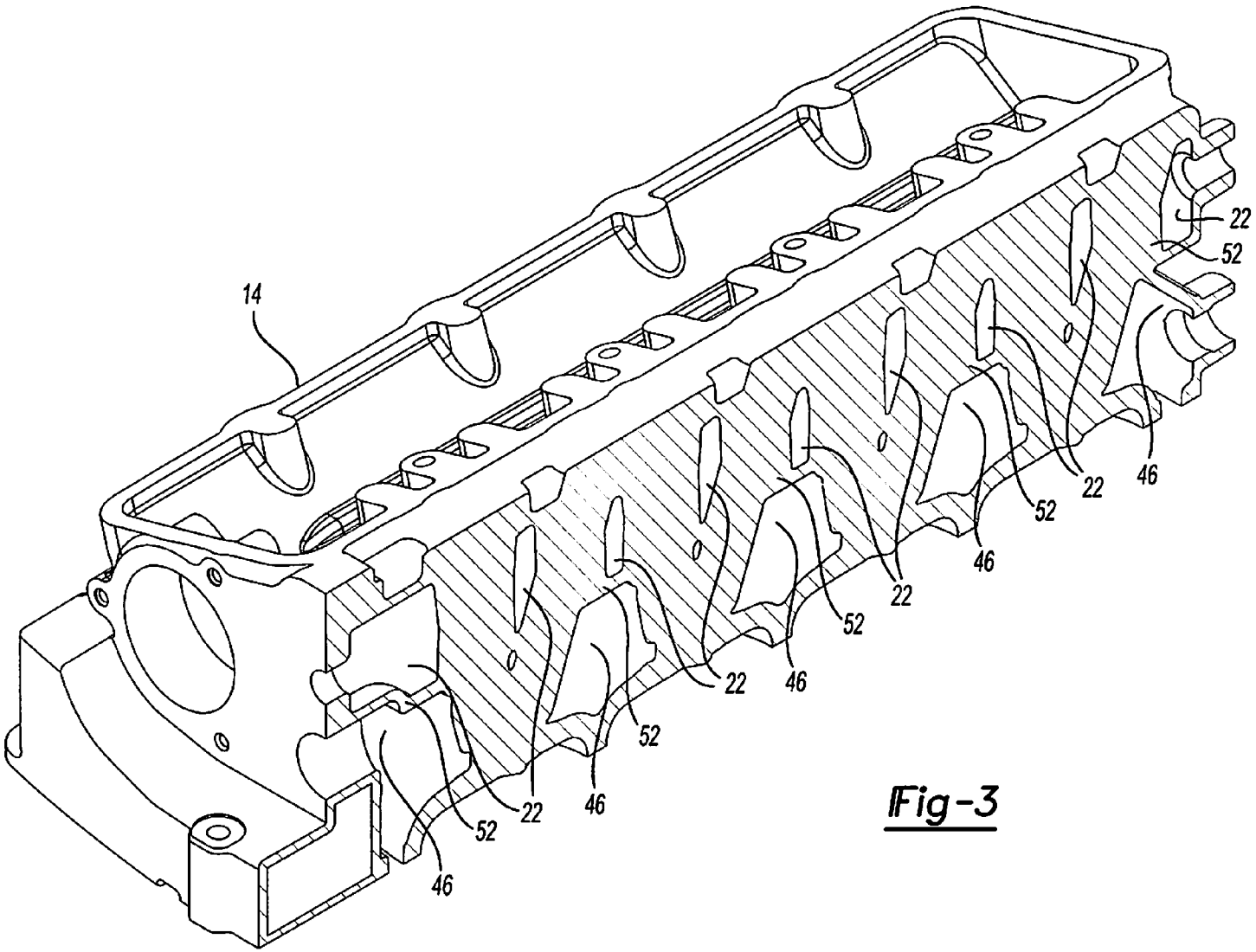
FIG. 3 is a perspective section view of the cylinder head shown in FIG. 1.

The engine coolant reservoir 46 may be in fluid communication with an engine radiator (not shown). The fluid volume 48 associated with the first hydraulic reservoir 20 and the fluid volume 50 associated with the engine coolant reservoir 46 are illustrated in FIG. 2. As seen in FIG. 2, the fluid volume 48 may include drain paths 28 in the cylinder head 14 providing direct fluid communication between the valve actuation systems 16 and the first hydraulic reservoir 20.

The first hydraulic reservoir 20 may overly the engine coolant reservoir 46 and may be in a heat exchange relation to the engine coolant reservoir 46, providing cooling for the hydraulic fluid within the first hydraulic reservoir 20. The fluid volume 48 associated with the first hydraulic reservoir 20 may transfer heat to the fluid volume 50 within the coolant reservoir 46. More specifically, the first hydraulic reservoir 20 and the engine coolant reservoir 46 may share a common wall 52 defined by the cylinder head 14. The engine radiator may therefore be used for cooling the fluid volume 48 within the first hydraulic reservoir 20. As a result, an auxiliary hydraulic fluid heat exchanger is not required. The cylinder head 14 may be formed from aluminum in order to enhance heat transfer capabilities.

What is claimed is:

1. A camless valvetrain system comprising:

a pressurized fluid supply;

a valve actuation assembly supported on an engine cylinder head and in fluid communication with the pressurized fluid supply; and a hydraulic fluid reservoir in fluid communication with the valve actuation assembly and in a heat exchange relation to an engine coolant reservoir located in the engine cylinder head.

2. The camless valvetrain system of claim 1, wherein a wall defining the hydraulic fluid reservoir defines the engine coolant reservoir.

3. The camless valvetrain system of claim 2, wherein the cylinder head defines the hydraulic fluid reservoir and the engine coolant reservoir.

4. The camless valvetrain system of claim 3, wherein the cylinder head is formed from aluminum.

5. The camless valvetrain system of claim 3, wherein the hydraulic fluid reservoir and the engine coolant reservoir each include passages cast into the cylinder head.

6. The camless valvetrain system of claim 1, wherein the valve actuation assembly includes a series of valve actuation systems, each of the valve actuation systems being in communication with the hydraulic fluid reservoir.

7. The camless valvetrain system of claim 1, wherein the pressurized fluid supply includes a pump in fluid communication with the hydraulic fluid reservoir.

8. The camless valvetrain system of claim 1, wherein the valve actuation assembly includes a valve member displaceable between an open and a closed position, the pressurized fluid supply providing a hydraulic fluid to the valve actuation assembly to displace the valve member to the open position and the valve actuation assembly exhausting the hydraulic fluid to the hydraulic fluid reservoir when the valve member is displaced to the closed position.

9. An engine assembly comprising:

a cylinder head defining an engine coolant reservoir;

a pressurized fluid supply;

a valve actuation assembly in fluid communication with the pressurized fluid supply, the valve actuation assembly including a valve member displaceable by a force applied by the pressurized fluid supply; and a hydraulic fluid reservoir in fluid communication with the valve actuation assembly and in a heat exchange relation to the engine coolant reservoir.

10. The engine assembly of claim 9, wherein a wall defining the engine coolant reservoir defines the hydraulic fluid reservoir.

11. The engine assembly of claim 10, wherein the cylinder head defines the hydraulic fluid reservoir.

12. The engine assembly of claim 11, wherein the cylinder head is formed from aluminum.

13. The engine assembly of claim 11, wherein the engine coolant reservoir and the hydraulic fluid reservoir each include passages cast into the cylinder head.

14. The engine assembly of claim 9, wherein the valve actuation assembly includes a series of valve actuation systems, each of the valve actuation systems being in communication with the hydraulic fluid reservoir.

15. The engine assembly of claim 9, wherein the pressurized fluid supply includes a pump in fluid communication with the hydraulic fluid reservoir.

16. The engine assembly of claim 9, wherein the valve member is displaceable between an open and a closed position, the pressurized fluid supply providing a hydraulic fluid to the valve actuation assembly to displace the valve member to the open position and the valve actuation assembly exhausting the hydraulic fluid to the hydraulic fluid reservoir when the valve member is displaced to the closed position.

17. An engine assembly comprising:

a cylinder head defining an engine coolant reservoir and a hydraulic fluid reservoir in a heat exchange relation to the engine coolant reservoir;

a pressurized fluid supply; and a valve actuation assembly in fluid communication with the pressurized fluid supply and the hydraulic fluid reservoir and including a valve member displaceable by a force applied by the pressurized fluid.

18. The engine assembly of claim 17, wherein the cylinder head defines a common wall defining the engine coolant reservoir and the hydraulic fluid reservoir and providing the heat exchange relation between the engine coolant reservoir and the hydraulic fluid reservoir.

19. The engine assembly of claim 17, wherein the pressurized fluid supply includes a pump in fluid communication with the hydraulic fluid reservoir.

20. The engine assembly of claim 17, wherein the valve member is displaceable between an open and a closed position, the pressurized fluid supply providing a hydraulic fluid to the valve actuation assembly to displace the valve member to the open position and the valve actuation assembly exhausting the hydraulic fluid to the hydraulic fluid reservoir when the valve member is displaced to the closed position.

* * * * *